US009458861B2

(12) United States Patent
Tang

(10) Patent No.: US 9,458,861 B2
(45) Date of Patent: Oct. 4, 2016

(54) DUST-PROOF FAN

(71) Applicants: AMBIT MICROSYSTEMS (SHANGHAI) LTD., Shanghai (CN); HON HAI PRECISION INDUSTRY CO., LTD., New Taipei (TW)

(72) Inventor: Shao-Chun Tang, Shanghai (CN)

(73) Assignees: AMBIT MICROSYSTEMS (SHANGHAI) LTD., Shanghai (CN); HON HAI PRECISION INDUSTRY CO., LTD., New Taipei (TW)

( * ) Notice: Subject to any disclaimer, the term of this patent is extended or adjusted under 35 U.S.C. 154(b) by 596 days.

(21) Appl. No.: 13/955,172

(22) Filed: Jul. 31, 2013

(65) Prior Publication Data

US 2014/0308114 A1 Oct. 16, 2014

(30) Foreign Application Priority Data

Apr. 10, 2013 (CN) ..... 2013 1 01216780

(51) Int. Cl.

| | |
|---|---|
| ***F04D 29/34*** | (2006.01) |
| ***F04D 29/70*** | (2006.01) |
| ***F04D 29/36*** | (2006.01) |
| ***F04D 25/06*** | (2006.01) |
| ***F04D 25/14*** | (2006.01) |

(52) U.S. Cl.

CPC ..... *F04D 29/703* (2013.01); *F04D 25/0613* (2013.01); *F04D 25/14* (2013.01); *F04D 29/36* (2013.01)

(58) Field of Classification Search

CPC .... F04D 19/02; F04D 25/0613; F04D 15/14; F04D 29/181; F04D 29/326; F04D 29/362; F04D 29/703; F05D 2260/77

See application file for complete search history.

(56) References Cited

U.S. PATENT DOCUMENTS

| | | | | |
|---|---|---|---|---|
| 2,357,771 A * | 9/1944 | Scofield | F04D 29/287 | 310/62 |
| 2,383,004 A * | 8/1945 | Mader | F04D 29/364 | 415/130 |
| 3,175,755 A * | 3/1965 | Rockafield | F04D 17/16 | 310/67 R |
| 3,580,694 A * | 5/1971 | Andersen | F04D 29/364 | 416/136 |
| 6,547,519 B2 * | 4/2003 | deBlanc | F04D 29/30 | 415/141 |
| 6,860,713 B2 * | 3/2005 | Hoover | F01D 5/00 | 415/66 |

FOREIGN PATENT DOCUMENTS

| | | |
|---|---|---|
| CN | 201521397 U | 7/2010 |
| TW | 153170 | 3/1991 |
| TW | 201102493 A1 | 1/2011 |
| TW | M399198 U1 | 3/2011 |
| TW | M448890 U1 | 3/2013 |

* cited by examiner

*Primary Examiner* — Ninh H Nguyen

(74) *Attorney, Agent, or Firm* — Zhigang Ma

(57) ABSTRACT

An exemplary dust-proof fan includes a frame, a stator mounted in the frame and a rotor received in the frame. The rotor includes a bracket and multiple blades pivotably mounted to the bracket. The bracket includes an inner ring and an outer ring surrounding the inner ring. Each blade has an inner pole inserted into the inner ring and an outer pole inserted into the outer ring. The blades are spaced from each other to form multiple airflow passages therebetween when the dust-proof fan is in use. The blades are overlapped with each other to close the airflow passages when the dust-proof fan is not in use.

19 Claims, 5 Drawing Sheets

DUST-PROOF FAN

BACKGROUND

1. Technical Field

The disclosure generally relates to a fan, and more particularly, to a dust-proof fan.

2. Description of Related Art

A typical fan includes a frame, a stator mounted in the frame and a rotor received in the frame. The rotor includes a shaft, a hub fixed to the shaft and a plurality of blades extending radially from the hub. In operation, the rotor is driven by the stator to rotate, thereby producing airflow by the blades thereof.

A plurality of passages are defined between adjacent blades for allowing airflow to flow through the fan. However, when the fan is not in use, dust in the outside environment may enter the interior the fan through the passages between the blades. The dust entering the fan will be accumulated and thus affect normal operation of the fan.

What is needed, therefore, is a dust-proof fan which can address the limitations described.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, like reference numerals designate corresponding parts throughout the various views.

DETAILED DESCRIPTION

Figure 1:
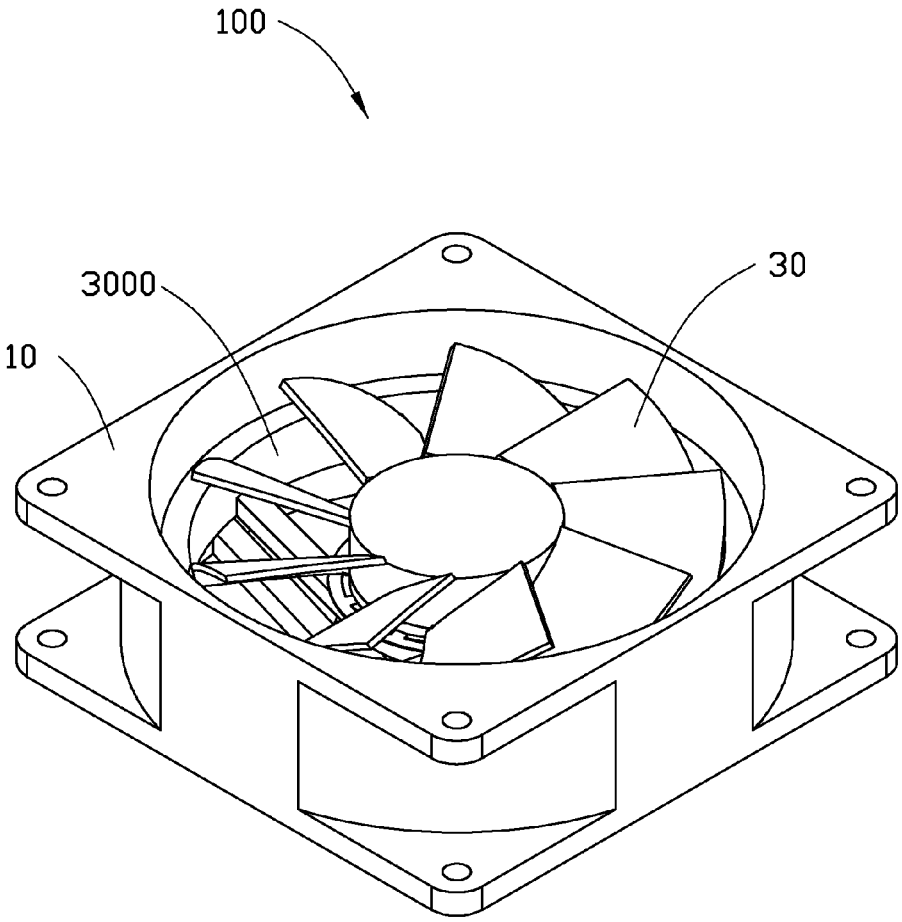
FIG. 1 shows a dust-proof fan in accordance with an embodiment of the present disclosure, wherein blades of the dust-proof fan are open.
Figure 2:
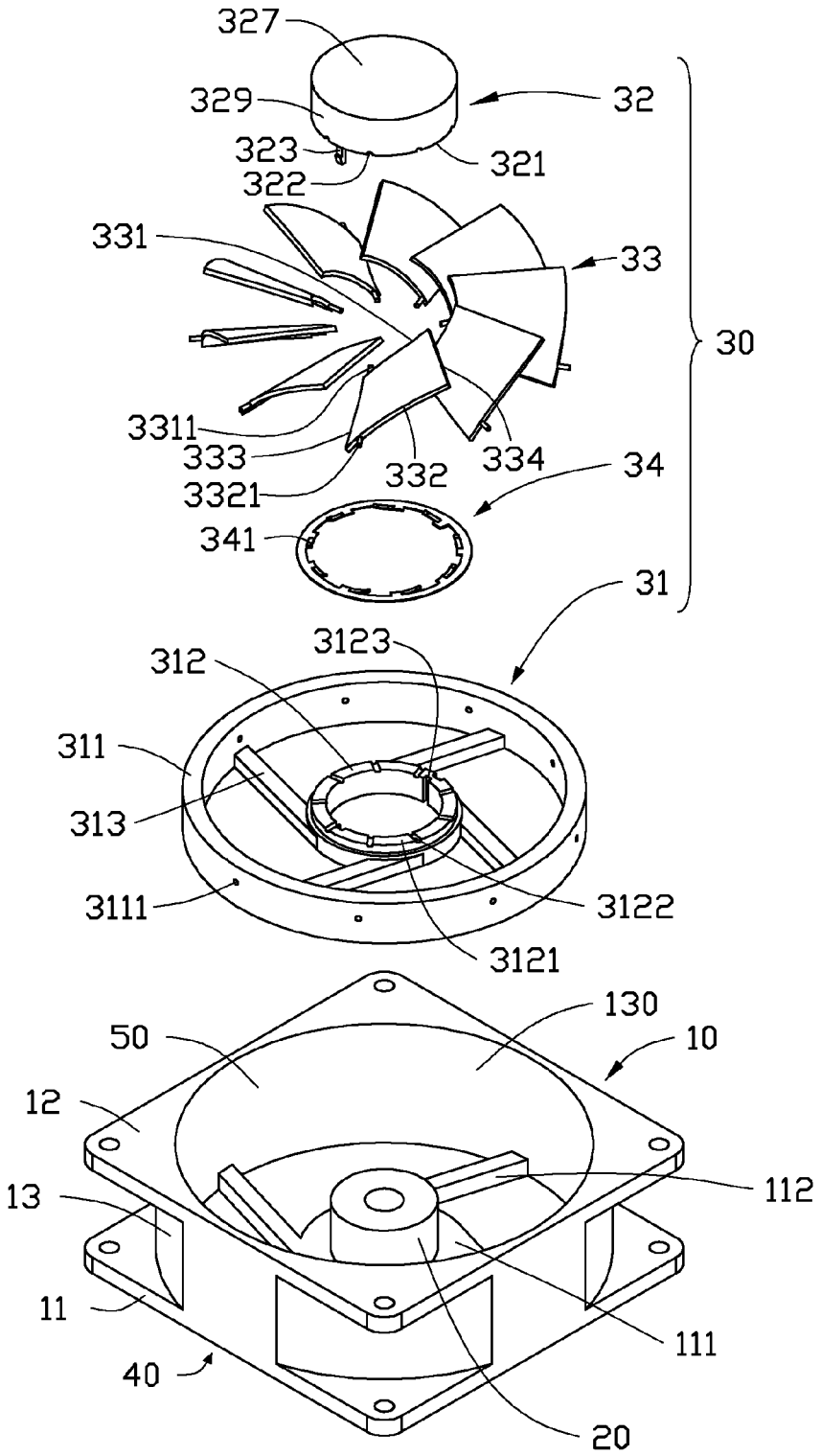
FIG. 2 is an exploded view of the dust-proof fan of FIG. 1.

Referring to FIGS. 1-2, a dust-proof fan 100 in accordance with an embodiment of the present disclosure is shown. The dust-proof fan 100 includes a frame 10, a stator 20 fixed in the frame 10 and a rotor 30 received in the frame 10.

Figure 3:
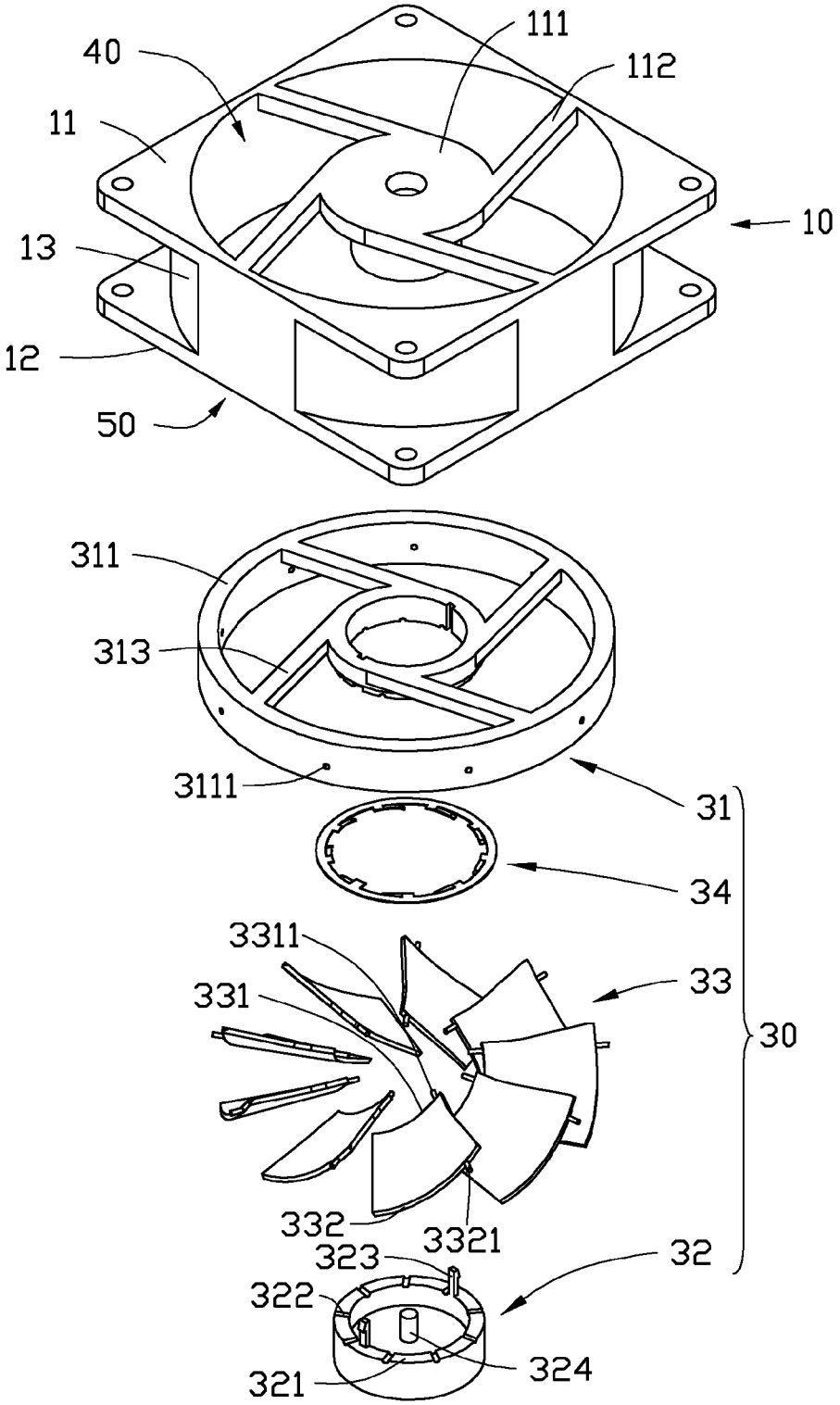
FIG. 3 is an inverted view of the dust-proof fan of FIG. 2.

Also referring to FIG. 3, the frame 10 includes a bottom plate 11, a top plate 12 parallel to the bottom plate 11 and a sidewall 13 interconnecting the bottom plate 11 and the top plate 12. The sidewall 13 is annular and surrounds an opening 130 through the bottom plate 11 and the top plate 12. The opening 130 forms an airflow inlet 40 in a bottom of the frame 10, and an airflow outlet 50 in a top of the frame 10. A supporting plate 111 is formed in the opening 130. The supporting plate 130 is flush with the bottom plate 11. A plurality of ribs 112 connect the supporting plate 111 with an inner circumferential face of the sidewall 13. The stator 20 is fixed on a top face of the supporting plate 111.

The rotor 30 includes a bracket 31, a plurality of blades 33 mounted in the bracket 31 and a hub 32 fixed on the bracket 31. The bracket 31 includes an outer ring 311 and an inner ring 312 surrounded by the outer ring 311. The inner ring 312 and the outer ring 311 are coaxial. The outer ring 311 has an outer diameter less than a diameter of the opening 130. Thus, when the bracket 31 is received in the opening 130, a gap is defined between an outer circumferential face of the outer ring 311 and the inner circumferential face of the sidewall 13, whereby the bracket 31 can be successfully rotated within the frame 10. The inner ring 312 has an inner diameter larger than an outer diameter of the stator 20. Thus, when the bracket 31 is sleeved onto the stator 20, a gap is defined between an inner circumferential face of the inner ring 312 and an outer circumferential face of the stator 20, whereby the bracket 31 can be successfully rotated around the stator 20. A plurality of holes 3111 are uniformly defined in the outer ring 311. Each hole 3111 extends from an inner circumferential face to the outer circumferential face of the outer ring 311. A plurality of grooves 3122 are uniformly defined in a top face 3121 of the inner ring 312. Each groove 3122 has a semicircular cross section. Each groove 3122 also extends from the inner circumferential face to an outer circumferential face of the inner ring 312. Each groove 3122 of the inner ring 312 is aligned with a corresponding hole 3111 of the outer ring 311. Two slots 3123 are defined in the inner circumferential face of the inner ring 312. Each slot 3123 extends from the top face 3121 to a bottom face of the inner ring 312. A plurality of ribs 313 are formed between and interconnect the inner ring 312 and the outer ring 311.

The blades 33 are mounted between the inner ring 312 and the outer ring 311. Each blade 33 is curved. Each blade 33 includes an inner end 331, an outer end 332 opposite to the inner end 331, a first lateral side 333 and a second lateral side 334 opposite to the first lateral side 333. The first lateral side 333 and the second lateral side 334 are located between the inner end 331 and the outer end 332 of the blade 33. Each blade 33 has an inner pole 3311 protruding inwardly from the inner end 331 and an outer pole 3321 protruding outwardly from the outer end 332. The inner pole 3311 and the outer pole 3321 of each blade 33 are located adjacent to the first lateral side 333 and away from the second lateral side 334. The inner pole 3311 and the outer pole 3321 of each blade 33 are aligned in a line. The inner pole 3311 of each blade 33 is inserted into a corresponding groove 3122 of the inner ring 312, and the outer pole 3321 of each blade 33 is inserted into a corresponding hole 3111 of the outer ring 311. Thus, each blade 33 is rotatable relative to the bracket 31 about the inner pole 3311 and the outer pole 3321 thereof. In this embodiment, the inner pole 3311 and the outer pole 3321 of each blade 33 cooperatively act a first rotation axis of each blade 33. Each blade 33 can be rotated around the first rotation axis within a plane perpendicular to the top plate 12 of the frame 10.

The hub 32 includes a cover 327, a flange 329 extending downwardly from a periphery of the cover 327 and a shaft 324 fixed to the cover 327. The cover 327 is circular such that the periphery of the cover 327 is coincidental with that of the inner ring 312. The flange 329 is annular and defines a plurality of grooves 322 in a bottom face 321 thereof. Each groove 322 also has a semicircular cross section. Each groove 322 of the hub 32 faces a corresponding groove 3122 of the inner ring 312. Each groove 322 of the hub 32 and a corresponding groove 3122 of the inner ring 312 cooperatively enclose a circular hole. The inner pole 3311 of each blade 33 is inserted into the circular hole enclosed by the grooves 322, 3122 of the hub 32 and the inner ring 312. Thus, the inner pole 3311 of each blade 33 is sandwiched between the hub 32 and the inner ring 312. The hub 32 further forms two buckles 323 extending downwardly from the bottom face 321 of the flange 329. Each buckle 323 is received in a corresponding slot 3123 of the inner ring 312 and locked with the bottom face of the inner ring 312, thereby securing the hub 32 with the bracket 31. The shaft 324 extends downwardly from a bottom face of the cover 327. The shaft 324 is inserted into the stator 20 to support the rotor 30 to rotate. The shaft 324 acts as a second rotation axis of the rotor 30. The rotor 30 can be rotated around the second rotation axis within a plane parallel to the top plate 12 of the frame 10. In other words, the first rotation axis of each blade 33 is perpendicular to the second rotation axis of the rotor 30.

Figure 5:
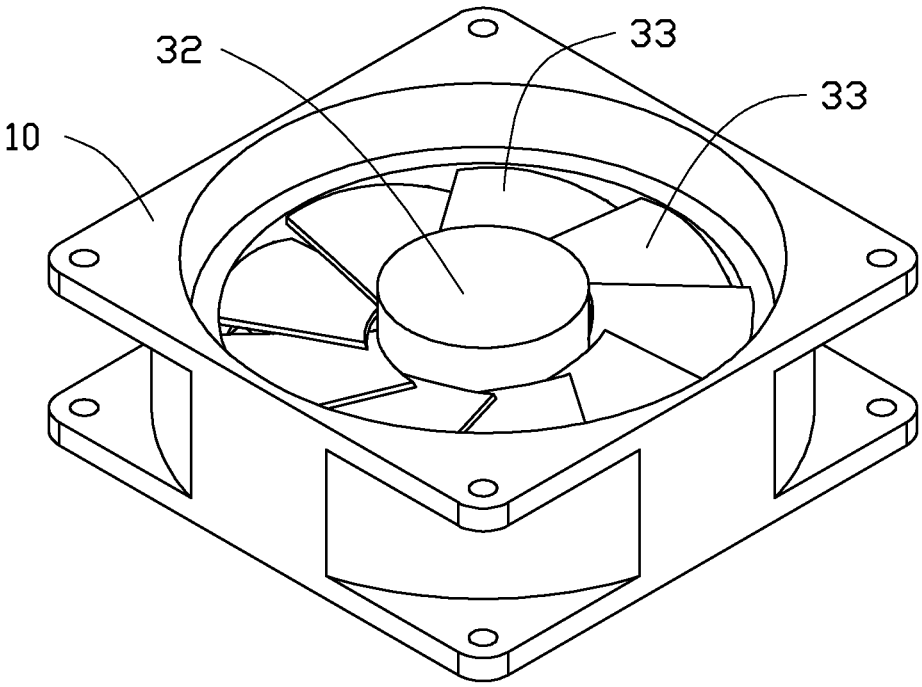
FIG. 5 is similar to FIG. 1, but showing the blades being closed.

Also referring to FIG. 5, when the dust-proof fan 100 is not in use, the blades 33 are overlapped with each other under gravity, such that the second lateral side 334 of each blade 33 covers the first lateral side 333 of an adjacent blade 33. Thus, no significant gap is formed between neighboring blades 33, whereby most of dust is prevented by the closed blades 33 from entering an interior of the dust-proof fan 100. When the dust-proof fan 100 is in use, the stator 20 is powered to drive the rotor 30 to rotate. The blades 33 are impelled by centrifugal force generated by rotation of the bracket 31 to rotate around the first rotation axes thereof. Thus, the blades 33 are open to make the second lateral side 334 of each blade 33 being spaced a gap from the first lateral side 333 of an adjacent blade 33. The gaps between the blades 33 form airflow passages 3000. An airflow can flow through the airflow passages 3000 between adjacent blades 33 to blow out of the airflow outlet 50 of the dust-proof fan 100.

Figure 4:
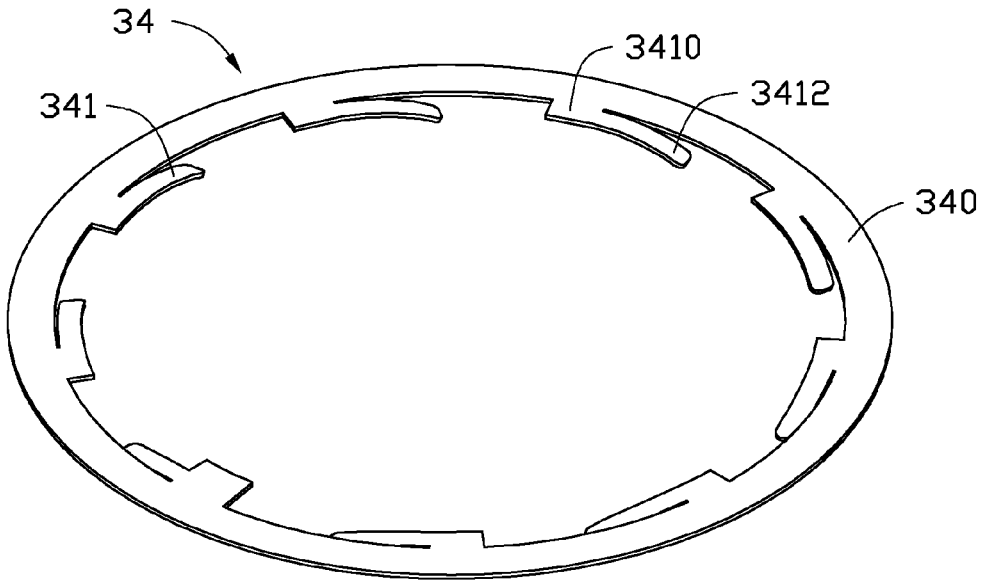
FIG. 4 is an enlarged view of a pressing ring of the dust-proof fan of FIG. 3.

Also referring to FIG. 4, in order to facilitate closure of the blades 33, a pressing ring 34 is further mounted on the bracket 31. The pressing ring 34 includes an annulus 340 and a plurality of pressing tabs 341 bending from the annulus 340 towards the blades 33. The annulus 340 has an inner diameter larger than an outer diameter of the inner ring 312 of the bracket 311 so that the inner ring 312 can be inserted through the annulus 340. Each pressing tab 341 is elastically deformable. Each pressing tab 341 has a fixed end 3410 connecting with an inner periphery of the annulus 340, and a free end 3412 bending towards the blades 33 away from the annulus 340. The pressing ring 34 is fixed on the bracket 31 in a manner that the annulus 340 surrounds the inner ring 312, and each pressing tab 341 is located just below a corresponding blade 33. When the dust-proof fan 100 is not in use, the free end 3412 of each pressing tab 341 presses against a bottom of the first lateral side 333 of a corresponding blade 33, to thereby urge the second lateral side 334 of the corresponding blade 33 to abut against the first lateral side 333 of an adjacent blade 33 intimately. Thus, the airflow passages 3000 between adjacent blades 33 are closed by the blades 33. When the dust-proof fan 100 is in use, the first lateral sides 333 of the blades 33 rotate around the first rotation axes 3311, 3321 thereof, to thereby press the free ends 3412 of the pressing tabs 341 to deform in a direction away from the blades 33.

It is to be understood, however, that even though numerous characteristics and advantages of the present embodiments have been set forth in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A dust-proof fan comprising:

a frame;

a stator mounted to the frame; and a rotor rotatable relative to the stator, the rotor comprising:

a bracket; and a plurality of blades pivotably mounted to the bracket;

wherein the blades are spaced from each other to define airflow passages between adjacent blades when the stator is powered to drive the rotor to rotate; and wherein the blades are overlapped with each other to close the airflow passages when the stator is not powered to make the rotor static; wherein the bracket comprises an inner ring and an outer ring surrounding the inner ring, the blades being located between the inner ring and the outer ring.

2. The dust-proof fan of claim 1, wherein each blade is pivotable relative to the bracket about a first rotation axis, and each blade is rotatable relative to the stator about a second rotation axis, the first rotation axis being not aligned with the second rotation axis.

3. The dust-proof fan of claim 2, wherein the first rotation axis is perpendicular to the second rotation axis.

4. The dust-proof fan of claim 2, wherein the bracket is rotatable relative to the stator about the second rotation axis.

5. The dust-proof fan of claim 1, wherein the bracket further comprises a plurality of ribs interconnecting the inner ring and the outer ring.

6. The dust-proof fan of claim 1, wherein each blade comprises an inner pole inserted into the inner ring and an outer pole inserted into the outer ring.

7. The dust-proof fan of claim 6, wherein the inner pole and the outer pole cooperatively define the first rotation axis.

8. The dust-proof fan of claim 7, wherein each blade comprises an inner end and an outer end opposite to the inner end, the inner pole protruding from the inner end towards the inner ring, and the outer pole protruding from the outer end towards the outer ring.

9. The dust-proof fan of claim 8, wherein each blade further comprises a first lateral side and a second lateral side opposite to the first lateral side, the first lateral side and the second lateral side being located between the inner end and the outer end, and the first rotation axis being located adjacent to the first lateral side more than the second lateral side.

10. The dust-proof fan of claim 9, wherein the second lateral side of each blade covers the first lateral side of an adjacent blade when the dust-proof fan is static.

11. The dust-proof fan of claim 9, wherein the rotor further comprises a pressing ring mounted on the bracket, the pressing ring surrounding the inner ring.

12. The dust-proof fan of claim 11, wherein the pressing ring comprises an annulus and a plurality of elastically deformable pressing tabs bending from the annulus, each pressing tabs pressing against the first lateral side of a corresponding pressing tab in a direction away from the inner ring.

13. The dust-proof fan of claim 6, wherein the rotor further comprises a hub mounted on the inner ring, the hub being surrounded by the blades.

14. The dust-proof fan of claim 13, wherein the inner pole of each blade is inserted into the hub.

15. The dust-proof fan of claim 13, wherein the hub comprises a buckle protruding towards the inner ring, the buckle locking with a bottom of the inner ring.

16. The dust-proof fan of claim 15, wherein the inner ring defines a slot in an inner periphery thereof, the buckle being received in the slot.

17. The dust-proof fan of claim 1, wherein the frame comprises a bottom plate, a top plate and a sidewall interconnecting the bottom plate and the top plate, the sidewall having an opening extending through the top plate and the bottom plate, and the rotor being received in the opening.

18. The dust-proof fan of claim 17, wherein the outer ring of the bracket is spaced from an inner periphery of the sidewall without contacting the sidewall.

19. The dust-proof fan of claim 17, wherein the frame further comprises a supporting plate received in the opening and a plurality of ribs connecting the supporting plate with the sidewall, the stator being fixed on the supporting plate.

* * * * *